US005123853A

United States Patent [19]

Gilbert et al.

[11] Patent Number: 5,123,853

[45] Date of Patent: Jun. 23, 1992

[54] CONNECTOR FOR ELECTROMAGNETICALLY SCREENED MULTICONDUCTOR CABLE

[75] Inventors: Gérard Gilbert, Tignieu; Jean-Paul Heng, Lyon; Ariel Ruiz, Villeurbanne, all of France

[73] Assignee: Entrelec S. A., Villeurbanne, France

[21] Appl. No.: 626,149

[22] Filed: Dec. 12, 1990

[30] Foreign Application Priority Data

Dec. 12, 1989 [FR] France ..... 89 16422

[51] Int. Cl.[5] ..... H01R 4/24

[52] U.S. Cl. ..... 439/98; 439/402

[58] Field of Search ..... 439/402–405, 439/417, 418, 98, 394

[56] References Cited

U.S. PATENT DOCUMENTS

| | | | |
|---|---|---|---|
| 4,284,316 | 8/1981 | Debaigt | 339/98 |
| 4,533,197 | 8/1985 | Prince et al. | 439/404 |
| 4,533,201 | 8/1985 | Wasserlein, Jr. | 439/404 |
| 4,626,058 | 12/1986 | Prince et al. | 339/97 P |
| 4,840,579 | 6/1989 | Heng et al. | 29/748 |
| 4,886,464 | 12/1989 | Zetena, Jr. | 439/98 |
| 5,011,428 | 4/1991 | Heng et al. | 439/394 |
| 5,055,064 | 10/1991 | Imaizumi et al. | 439/607 |

FOREIGN PATENT DOCUMENTS

| | | | |
|---|---|---|---|
| 255722 | 7/1926 | United Kingdom | 439/98 |

*Primary Examiner*—Gary F. Paumen

*Attorney, Agent, or Firm*—Sughrue, Mion, Zinn, Macpeak & Seas

[57] ABSTRACT

A connector ensure the wired connection of a piece of equipment in series with a multiconductor cable for transmitting low currents.

A support block (5) has a plate on which through and closed end grooves are formed respectively for the passage of the wires of the cable (2) and wires (3A, 3A') for connecting equipment in series. The closed end grooves be adjacent one of the through grooves, at the level of a connection piece (6) partially housed in these two grooves for interconnecting wires. Each of the through grooves (20A) is provided with a median cavity (21) which interrupts the grove locally and which receives a wire cutting device means (6C). The two connection pieces housed in the same through groove are situated on each side of the cavity (21) and each allows the connection of a second different wire (3A, 3A').

12 Claims, 9 Drawing Sheets

12
26
30
29
33
32
27
34
40
6
35
25
28
5
23A'
23A
20C
20A
37

CONNECTOR FOR ELECTROMAGNETICALLY SCREENED MULTICONDUCTOR CABLE

FIELD OF THE INVENTION

The invention relates to a connector, for a multiconductor cable used for transmitting low currents and being electromagnetically screened, which is provided for wiring a piece of equipment in series with the cable, this latter having at least one pair of insulated wires and electromagnetic screening of the metal sheath type with which a connector drain might be associated and electrically connected.

BACKGROUND OF THE INVENTION

The construction of local networks with multiple stations uses in particular connections for transmitting data in digital form whose transmission medium is formed by a common multiconductor cable, very often an electromagnetically screened cable comprising two insulated wires.

A plurality of pieces of equipment for example compatible processors and/or terminals are then connected together in series by the common cable along which they are spaced apart.

For reasons of convenience, economy and reliability, formation of the wiring and the connections tends to be carried out more and more in the factory, as much as possible, rather than on the site to the extent that it is easier to have there all the means required for implementation and testing and where the production conditions are easier to control.

Thus, the tendency is to be able to deliver network harnesses comprising the common cable along which all the individual connectors and branch wiring are mounted and connected for connecting up the equipment to be served by the cable, via the connectors. The branch cables of such harnesses are themselves often connected to component elements of equipment served, for example to the transmitter-receiver units of this equipment which are then housed in appropriate cases.

Such harnesses thus equipped can be stored on drums for transport and each harness is unwound and connected on the site, the connecting operations being thus considerably reduced. However, to the extent that the whole of the equipment is not necessarily used immediately on installation, it is useful for the connectors to be able to be fitted on the cables without however being necessarily inserted in series on the connection, when the equipment to be served is not in position, since the series electrical connection would then risk being interrupted at the level of the connector and/or of the connecting cable concerned. It is also important for the connectors to be able to be added subsequently.

SUMMARY OF THE INVENTION

The invention proposes then a connector, for a multiconductor cable used for transmitting low currents and electromagnetically screened, which is adapted to provide the wiring up of a piece of equipment in series with the cable, this connector being adapted so as to be able to be mounted and connected simply and reliably, so as to be able to store the branch cable which it serves with the main cable, after at least partial mounting and connection, for withstanding the forces related to the installation along the path of the common cable and so as to allow, if required, fitting or connection at any point to a common cable already equipped or installed.

The connector, for a multiconductor cable used for the transmission of low currents and electromagnetically screened, is provided for wiring up a piece of equipment in series with a cable, called a first cable, via conducting wires, called second wires, this first cable comprising at least one pair of insulated conducting wires and an electromagnetic screen, comprising a metal sheath to which a drain, called a ground conductor, is possibly associated and electrically connected. According to a characteristic of the invention, the connector comprises a support block with a plate on which grooves are formed individually, on the one hand, from one side to the other for the passage of the conducting wires and of the ground conductor of the first cable, and on the other hand closed at one end and open at the other for one end of each of the second wires. The closed grooves are each adjacent one of the through grooves, for conducting wires of the first cable, at the level of a connection piece with slots for holding and baring wires housed partially in the two grooves considered which are adjacent, for interconnecting the two wires able to be placed respectively each in one of these two grooves. Each of the through grooves has a median cavity, which interrupts it locally and on one of the edges of which extend cutting means disposed to allow a transverse cut of a wire passing longitudinally through the groove considered. The two connection pieces housed in the same through groove are situated on each side of the cavity, with which this through groove is provided and each allows the connection of a second different wire.

BRIEF DESCRIPTION OF THE INVENTION

The invention, its characteristics and advantages are given in the following description, with reference to the following figures.

DESCRIPTION OF THE PREFERRED EMBODIMENT

Figure 1:
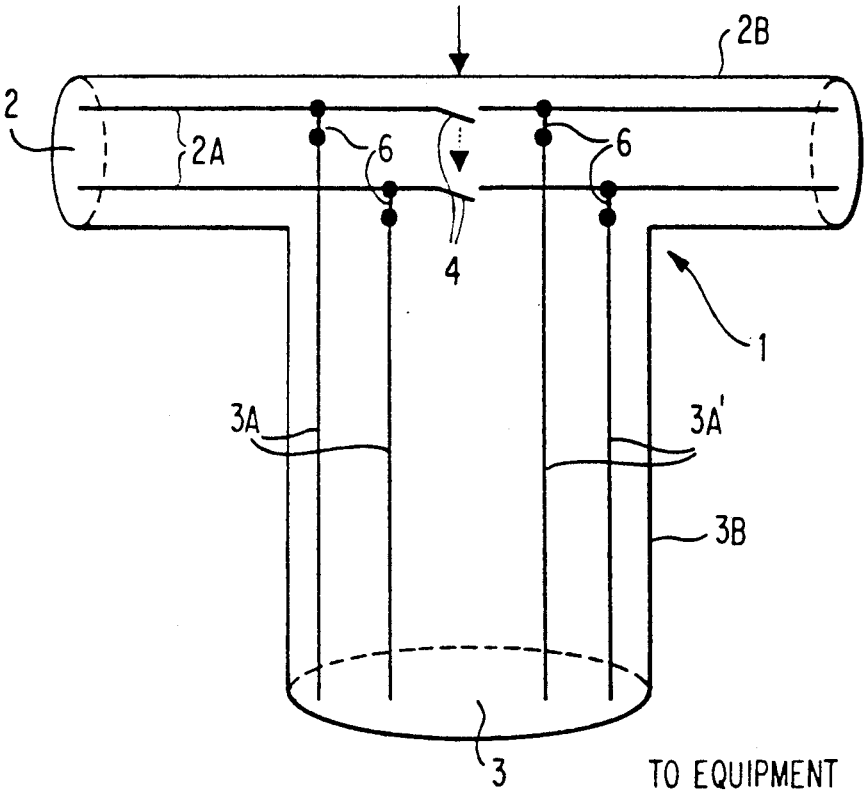
FIG. 1 is an electric diagram of the connector for connecting a piece of equipment in series via conducting wires with an electromagnetically screened multiconductor cable.

The connector 1 shown schematically in FIG. 1 is used for connecting in series low current equipment, not shown for example a data processing terminal, to a first multiconductor and electromagnetically screened cable 2 by means of conducting wires belonging very often to a second cable 3, the first cable, often called bus, being then used for connecting the equipment considered to other identical or compatible equipment, for data exchanges transmitted in the form of digital signals.

For well known reasons of confidentiality and protection not only of the signals transmitted with respect to possible interferences but also the external environment with respect to the same signals, the cables are electromagnetically screened.

The first cable used for connecting the equipment served usually comprises at least two electrically insulated conducting wires 2A for transmitting the signals and an electromagnetic screen 2B which clads them, the whole being itself clad with at least one or more insulating layers.

In the embodiment considered, the first cable is formed of a pair of conducting wires insulated from each other and commonly housed in a metal screening sheath.

Figure 2:
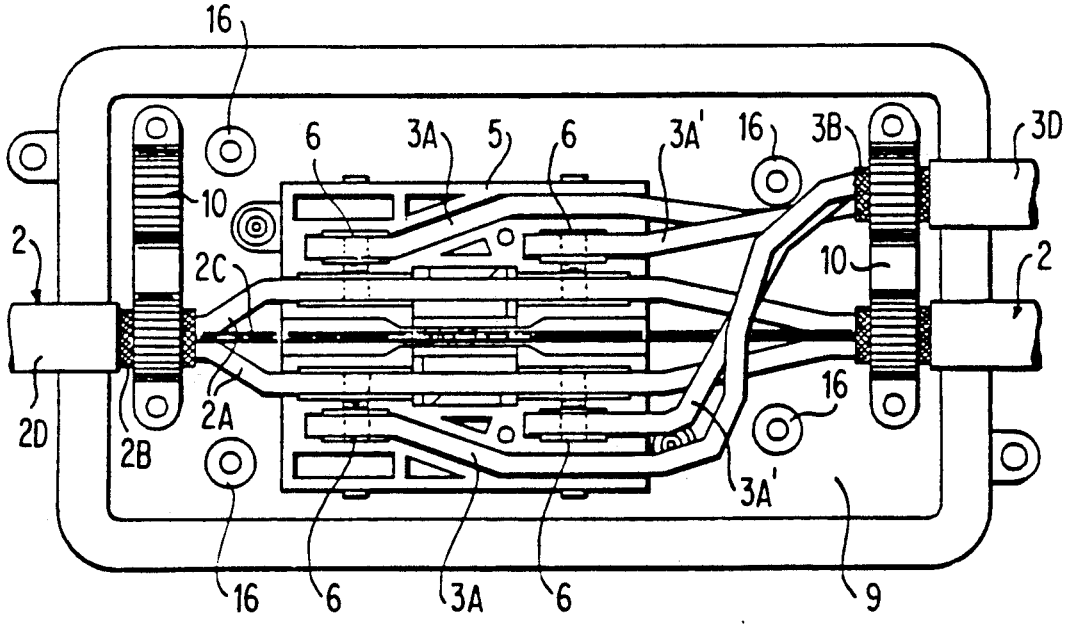
FIG. 2 is a schematic top view of the lower part of a wired up connector according to the invention.

This sheath is preferably associated with a drain 2C serving as ground conductor at the level of possible connectors, as can be seen in FIG. 2; this ground conductor is for example formed by a multistrand metal wire disposed parallel to the two insulated wires in the sheath which envelopes them and with which it is electrically in contact along the cable. The ground conductor 2C is here used for providing the electric continuity of the screening sheath 2B when the cable 2 is to be opened for positioning a connector 1, this involving removal of a portion of the screening sheath and of the insulating sheath 2D which covers them for gaining access to the wires 2A transmitting the signals. However, connector 1 is able to receive other cables, in particular if the screening thereof comprises a portion comparable to a multiconductor wire at the level of an opening formed in the cable, at a position chosen along this cable for fixing a connector.

The second cable 3 is likely to be a cable such as defined above or more conventionally a cable in which the insulated connectors, here referenced 3A or 3A', are housed under a screening sheath 3B, without drain, particularly when the second cable is only connected at its ends, the screening sheath being itself covered with at least one insulator 3D.

As mentioned above, the connector 1 of the invention is intended to permit the series connection to the cable 2 of a piece of equipment to be served, which involves the use of two pairs of conducting wires between the connector and the equipment, as can be seen in FIG. 1, these two pairs of wires 3A, and 3A' belonging very often to the same cable 3, in the screening sheath 3B of which they are placed.

The series connection of the equipment to the first cable 2 means, as is known, that the two pairs of wires 3A and 3A' are connected on each side of an interruption which is formed in the pair of wires 2A by means of appropriate members 4 of the connector 1 and which is here shown symbolically by contacts 4 which, when opened, connects the equipment served, not shown, in series to cable 2 via wires 3A and wires 3A'.

In the embodiment chosen, connector 1 provides for introduction of the second cable 3 in parallel on the first cable 2 which passes through the connector from one side to the other, as can be seen in FIG. 2. This avoids cutting the first cable completely at the level of the connectors and in particular provides uninterrupted ground continuity along this first cable, via the screening sheath 2B and, in the embodiment shown the ground conductor 2C. The introduction of the second cable 3 in connector 1 in parallel with the first cable 2, here disposed longitudinally, offers the additional advantage of facilitating storage on a drum of a first cable equipped with connectors fitted with their second cables and possibly compact elements belonging to the equipment served, not shown here.

Connector 1 comprises then a support block 5 on which are positioned connection pieces 6 for connecting the different wires 3A, 3A' in pairs to wires 2A respectively on each side of a central zone where wires 2A will be interrupted for connecting the equipment to be served in series.

The ground conductor 2C of cable 2 passes centrally through the support block 5 without being interrupted, whereas the corresponding screening sheath 2B is annularly sectioned as well as the sheath which covers it at the position chosen for connector 1, so as to give access to wires 2A and consequently to the ground conductor 2C. Cutting an annular cable portion 2 which surrounds the screening sheath 2B, for removing this portion, is carried out for example using a cutting tool adapted to alternately split the external insulating sheath of the cable peripherally or longitudinally.

Figure 3:
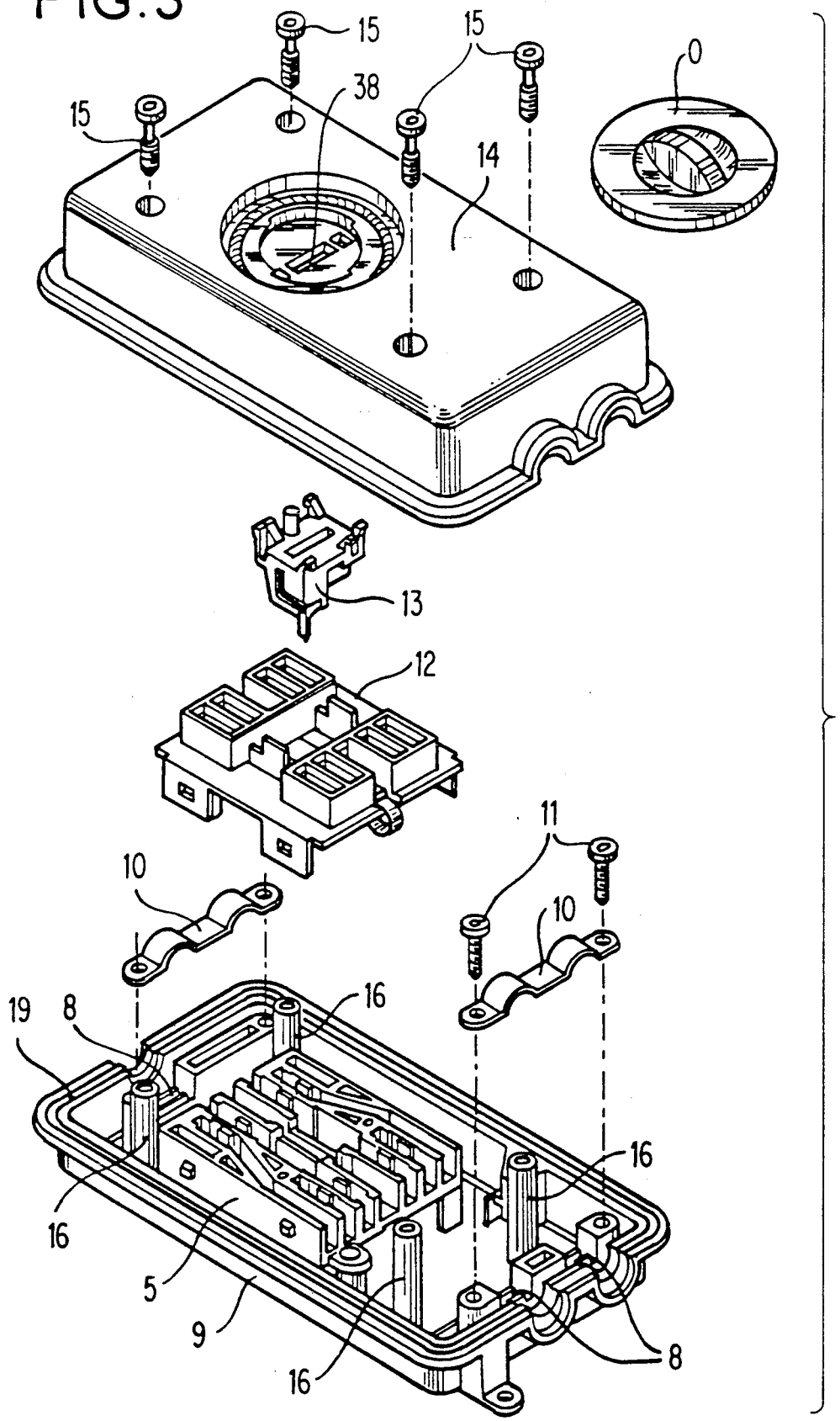
FIG. 3 is an exploded perspective view of the connector according to the invention.

The screening sheaths 2B, 3B which are also cut peripherally are shown folded back on the insulating sheath of the cable of which they form part so as to form connecting rings which rest on corresponding surfaces 8 of the bottom of case 9 in which the support block 5 is housed—see FIG. 3.

Conducting collars 10 immobilize the bottom of case 9 on cable 2 at the ends of this case and on cable 3, electric conduction between the collars and the bottom of case 9 which is electrically connecting being provided by fixing screws 11, electric continuity is thus provided between the screening sheath 2B and 3B as well as with the bottom of the case through the collars and screws.

In a preferred embodiment, not shown, the screening sheath 2B is cut with the insulating sheath 3D which covers it, at the same level as it, on each side of the zone where wires 2A and the ground conductor 2C are free for the connection to be formed through connector 1, the collars 10 clamping this cable 2 on its insulating sheath 2D and cable on its braid 3B. This in fact simplifies the fitting procedure.

Figure 5:
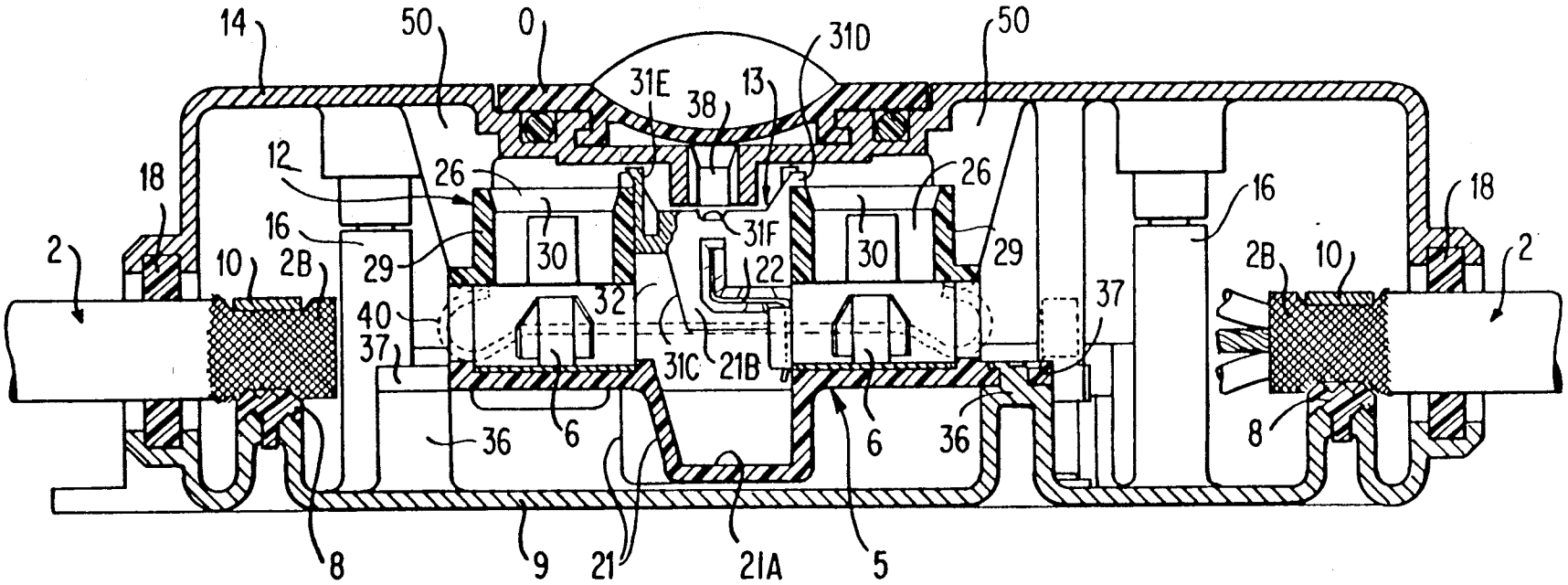
FIG. 5 is a longitudinal section through V—V of the assembled connector.

FIGS. 3 and 5 show the assembly of component elements of the connector according to the invention which also comprises a cutting device which is positioned in the central interruption zone of the wires 2A and is formed by a cutting slide 13 cooperating with the support block 5 and with a connection lid 12 which is placed on this support block.

The assembly thus formed is enclosed in the case formed by the bottom of case 9 and a complementary cover 14. Bottom 9 and cover 14 of the case are fitted one on the other and are here fixed by means of screws 15 whose heads emerge on the cover and are fixed in columns 16 projecting from bottom 9. Case 9, 14 is sealed by a set of seals, such as seal 17, 18, here shown respectively positioned in a groove 19 in the joint plane between the bottom and the lid of the case and with three cable inputs 2 and 3 in this case—see FIGS. 3, 4 and 5.

The support block 5 shown in detail in FIGS. 4, 5, 10 and 12 comprises an upper plate with grooves for wires 2A, 3A, 3A' and for the ground conductor 2C. The latter is housed in a central groove 20C on each side of which are placed two lateral grooves 20A where the two wires 2A of the first cable are housed respectively.

Figure 13:
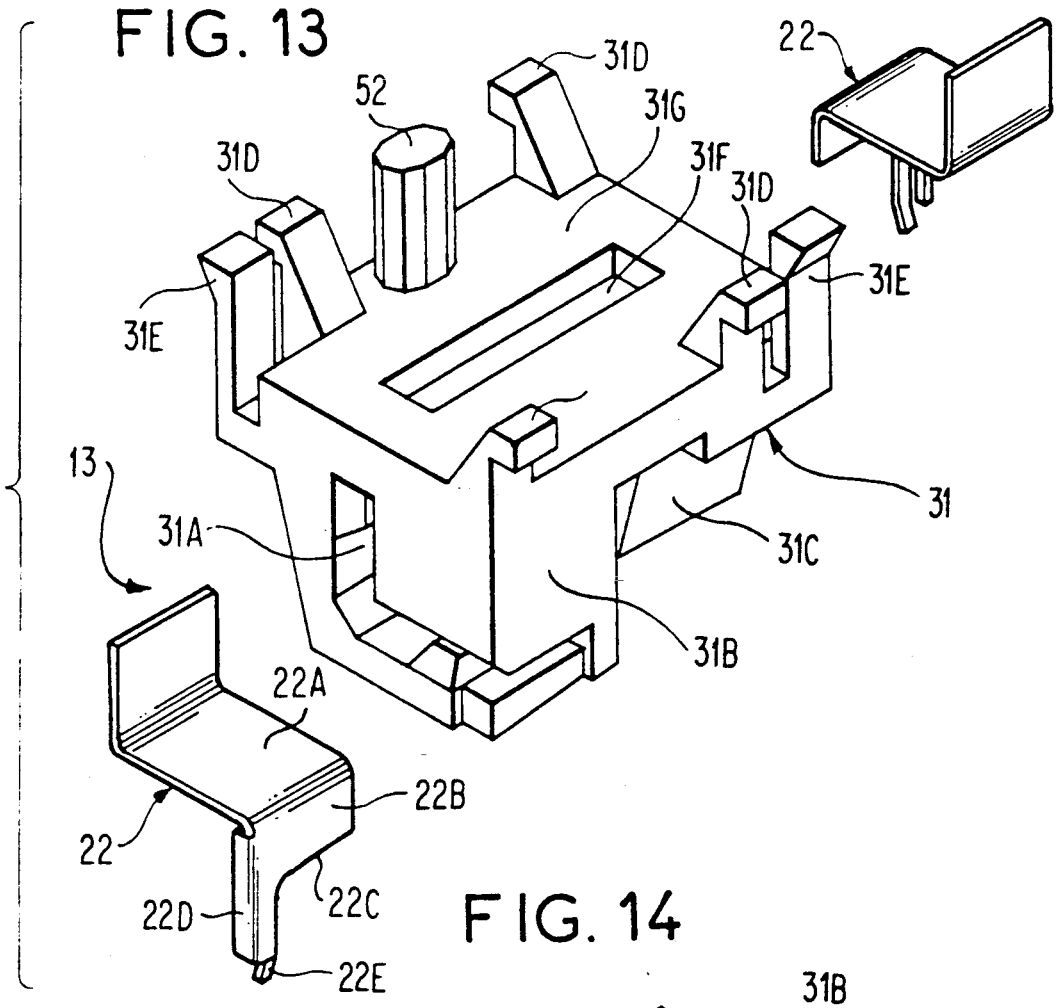
FIG. 13 shows the slide for cutting the connector in exploded perspective and seen from the top.

These lateral grooves 20A each have a median cavity 21, these cavities being disposed on each side of the central groove under the grooved plate and are intended to receive one end of one of the wires 2A after it has been cut by one of the two knives 22 of FIG. 13. The slide 13 comprises each knife and the portions which carry them.

Two pairs of grooves 23A and 23A' which are blind, contrary to the through grooves 20A and 20C, emerge at one end of the support block 5 parallel to the grooves; they are intended for each receiving one end of one of the wire 3A, 3A' to be connected to a wire 2A. These grooves each extend at the side of a groove provided for one of the wires 2A, the two grooves 23A extending on each side of the assembly formed by grooves 20A, 20C on the other side of cavities 21 with respect to grooves 23A' which also extend on each side of the assembly formed by grooves 20A, 20C.

A connection piece 6 serves for electrically connecting each of the wires 3A, 3A' to one or other of the wires 2A, each connection piece 6 being positioned at the bottom of a groove 20A and of the blind end of the adjacent groove 23A or 23A', here straddling the border separating these two grooves.

Figure 7:
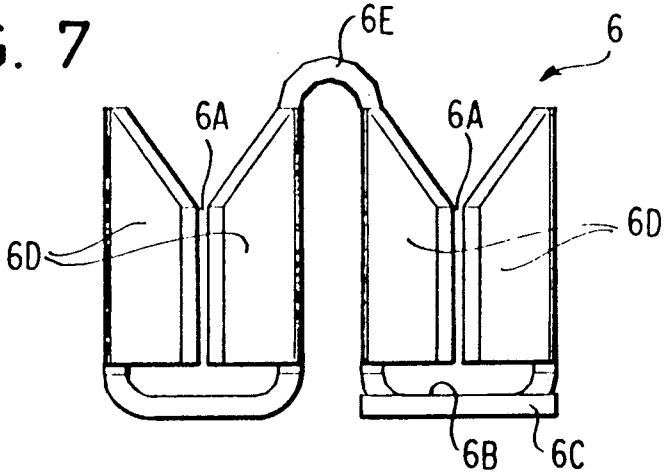
FIGS. 6 to 9 show respectively one example of a connection piece, seen from the front, from the left, from the top and in perspective.
Figure 6:
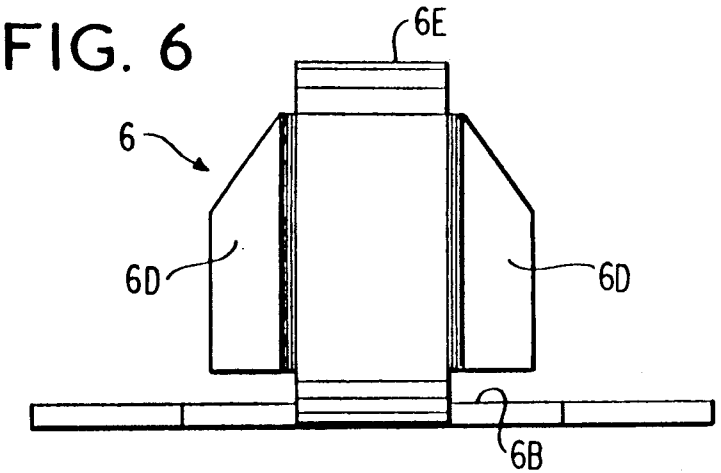
Figure 9:
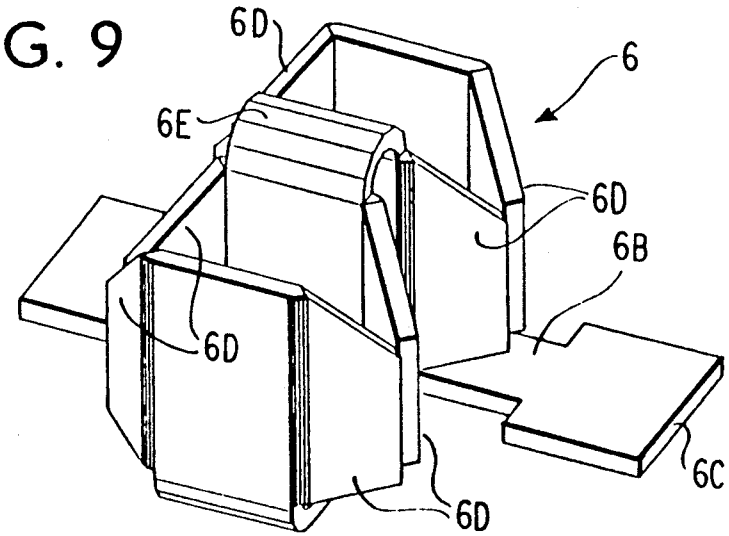
Figure 8:
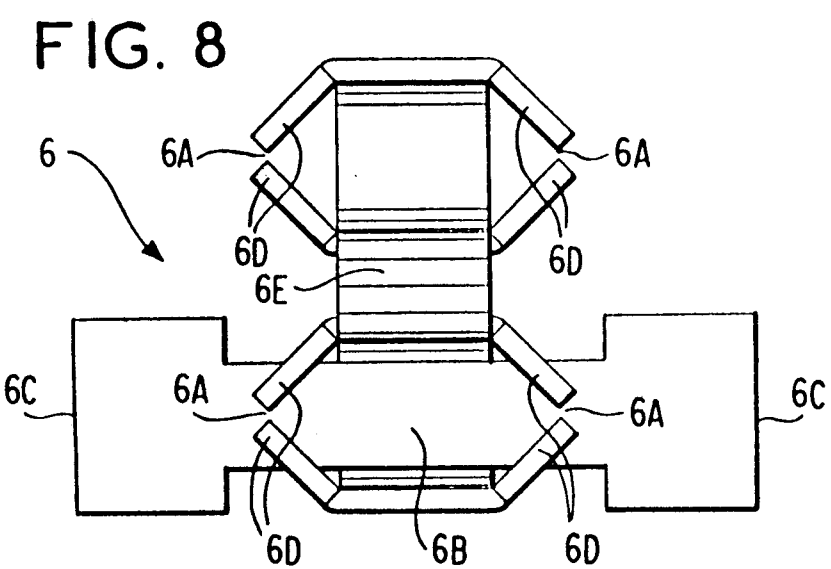

The connection pieces 6 are identical and are positioned symmetrically not only with respect to the central groove 20C but also transversely thereto. Each piece 6 comprises two parallel connection units each adapted to receive an insulated wire in two wire baring and holding slots 6A, as can be seen in FIGS. 7 and 8.

Figure 4:
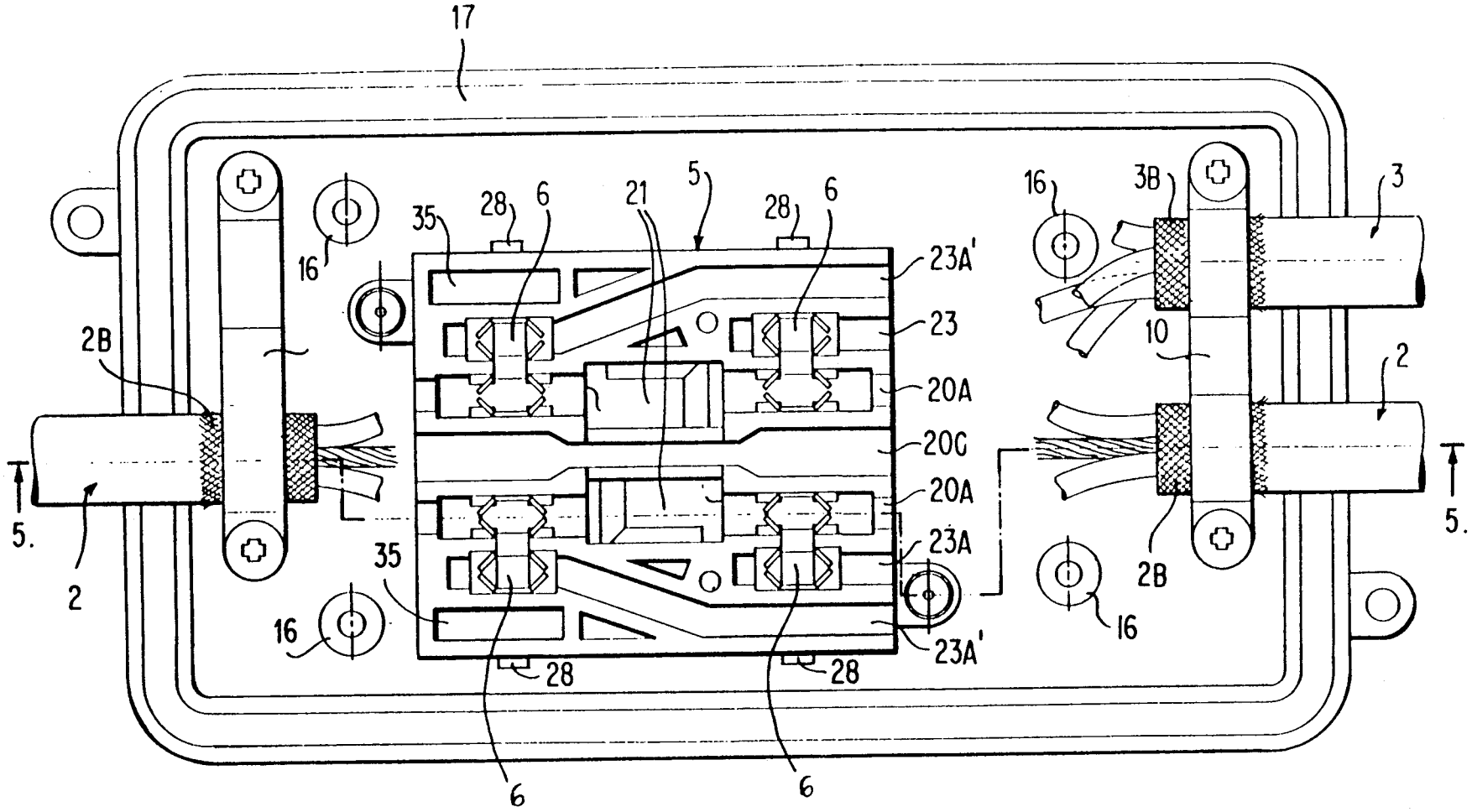
FIG. 4 is a schematic top view of the lower part of the connector.

In the embodiment shown, piece 6 is formed by cutting and bending a conducting metal strip. One of the connection units intended to be housed in one of grooves 20A comprises a longitudinal base 6B extending on each side of the connection unit under which it is placed. One of the two ends 6C of each base is positioned at the edge of cavity 21 which opens into groove 20A at the bottom of which the base is housed as can be seen in FIG. 4. Each end 6C adjacent a cavity 21 forms one of the two cutting blades for cutting wire 2A contained in the groove into which the cavity opens, during the series connection to cable 2 of equipment served by the connector 1 considered.

Figure 10:
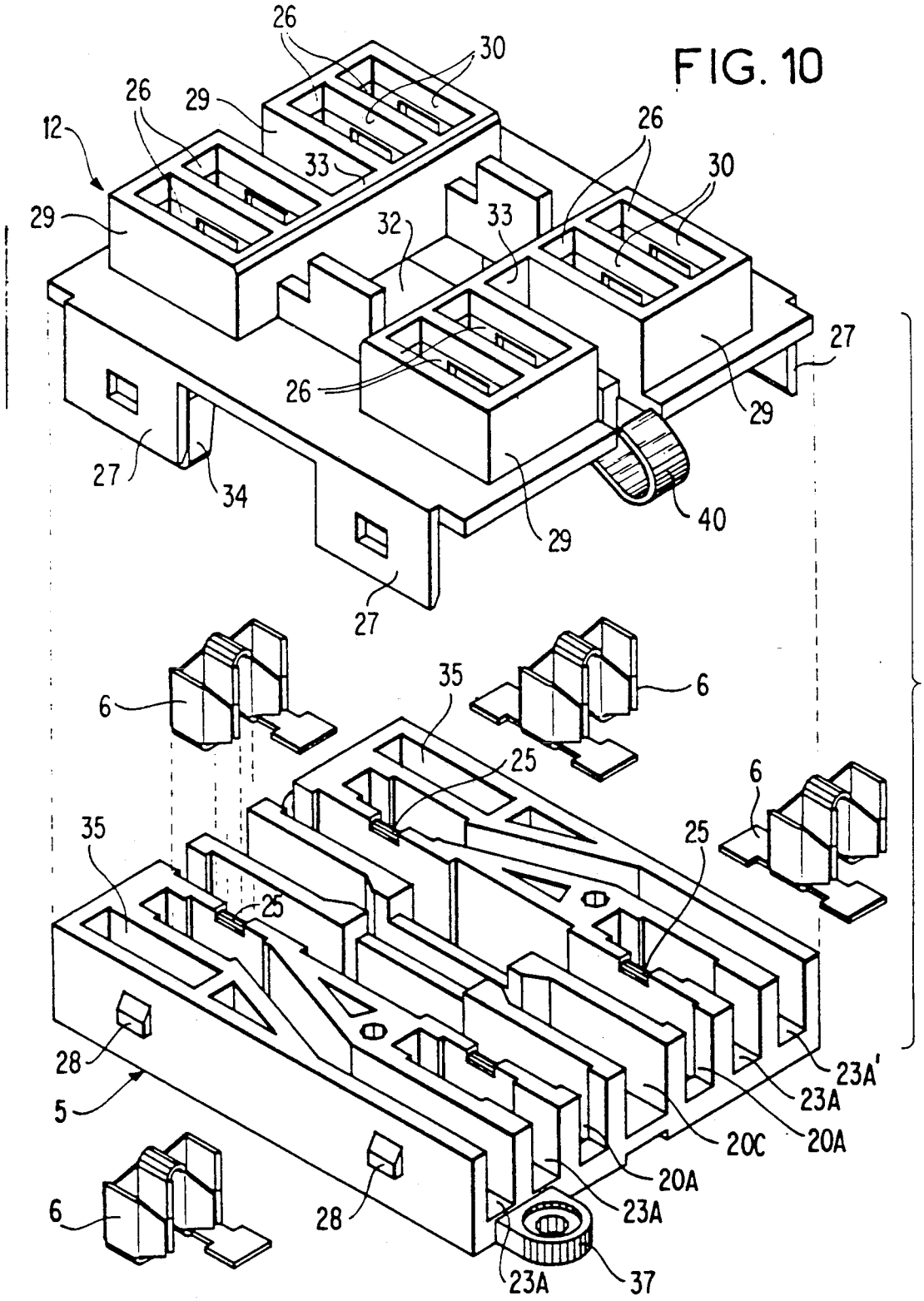
FIG. 10 shows a support block for the connection pieces and a connection lid of the connector, in perspective and seen from the top, with the screening plate and in parallel connection pieces.

The two connection units whose slots 6A are formed, in a conventional arrangement, by obliquely bending two trapezoidal extensions 6D, initially parallel, towards each other, are joined together by a bridge 6E which here straddles the border separating two neighbouring grooves 20A and 23A or 23A' at the level of a positioning recess 25—see FIG. 10.

The insertion of wires 2A, 3A and 3A', in slots 6A of the connection pieces, is preferably achieved using a tool for positioning under optimum conditions which are easily reproducible particularly if the connections are made in the factory, possibly automatically by machines.

In the embodiment proposed, a tool of the type described in the international application PCT/FR/87/00837 and the European application 0265321 is preferably used and lid 12 comprises fixing means similar to those provided in the above applications for a connection tool, similar to the one described in these applications.

Figure 11:
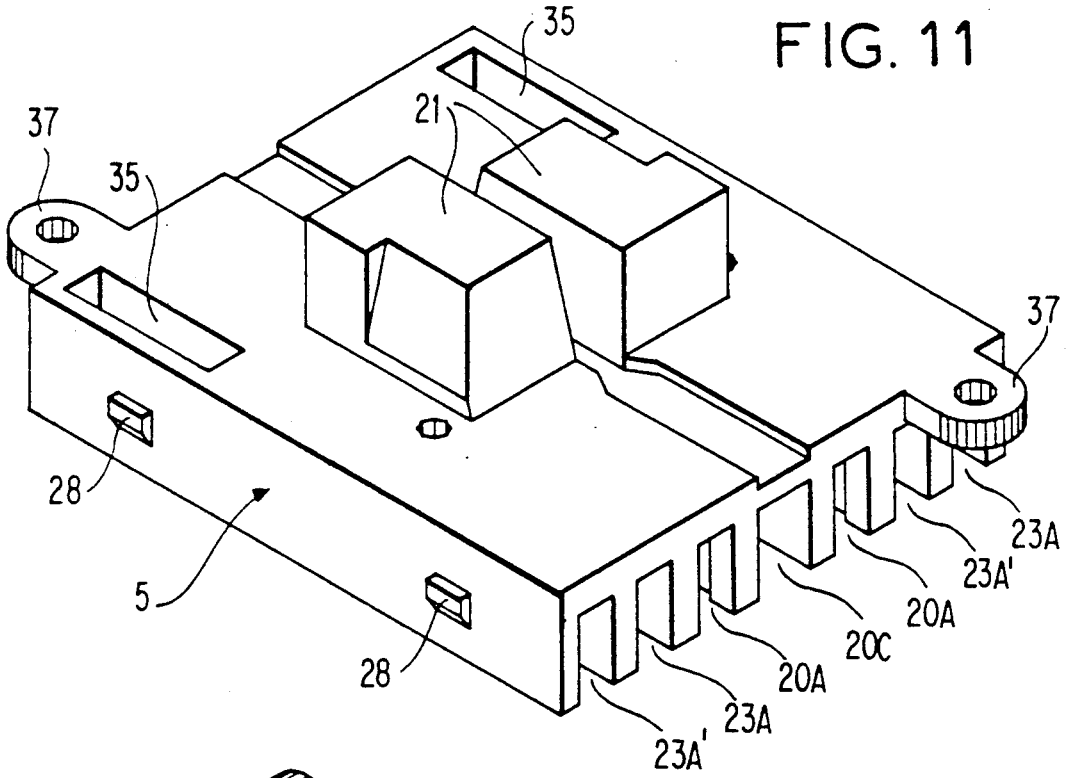
FIG. 11 shows the block for supporting the connection pieces, in perspective and seen from below.

This means that lid 12 comprises as many tool insertion and positioning orifices 26 as there are connection units, namely two orifices 26 per piece 6, each overhanging the two slots of the connection unit to which it is assigned. For this, the complementary lid 12 is fixed on the support block 5 on which it bears and is fitted, fixing being provided for example by a system of fixing lugs 27 carried by the complementary lid and clipping on to lateral projections 28 of the support block and by the penetration of positioning studs 34 of the lid into complementary housings 35 of the support block—FIGS. 10 and 11.

In the embodiment shown, orifices 26 are rectangular and each has a rectangular projection 29 in the centre of which opens the orifice 26. An insertion blade with rectangular section of the tool penetrates by translation into this orifice. The end of this tool which carries the mobile insertion blade covers at least partially the rectangular projection 29 whose orifice 26 comprises on the inside engagement flanges 30, here longitudinal—FIGS. 5 and 10—for mobile fixing elements which are carried by the tool and which are adapted to penetrate into orifice 26 prior to the insertion blade for engaging flanges 30 while immobilizing the tool with respect to the lid 12—support block 5 assembly, during actuation of the insertion blade, in the connection phase of a wire.

The mobile fixing elements of the tool are for example formed by two flexible blades fixed to the end of the tool where the insertion blade slides on each side of this insertion blade with which they project. Each of the two blades ends in a bead so that the two bead carrying ends are applied one against the other when the insertion blade is retracted, which enables them to be inserted in an orifice 26. Removal of the insertion blade by sliding between the two blades forming the mobile fixing means causes the beads to move apart under the flanges in orifice 26 and prevents the tool from being removed as long as the insertion blade has not been again removed by an appropriate mechanism which is not described here.

The insertion blade is for example longitudinally grooved for passing between the edges of extension 6D which each define the two slots 6A of a connection unit, and it penetrates by longitudinal sliding into an orifice and into the two slots 6A which it overhangs while bearing transversely on the conductor previously positioned in the corresponding groove of the support block 5 perpendicularly to the two slots which it overhangs.

As mentioned above, the connection of the wires is able to be carried out either on the site by means of a tool such as mentioned above or preferably in the factory with high performance means for example a tool with multiple blades providing simultaneous connection of the different wires of cables 2 and 3 extending to connector 1. On the other hand, connection of equipment in series to cable 2 by means of cable 3 involves cutting the wires 2A at the level of cavities 21. For this, a cutting slide 13 is positioned above conductors 2A at the level of cavities 21, into which it penetrates while cutting each of the wires at a point and causing one of the two ends of each of the two wires cut to enter one of the cavities 21 so as to remove it definitely from the end, formed by the cut, with which it was previously in continuity.

Figure 12:
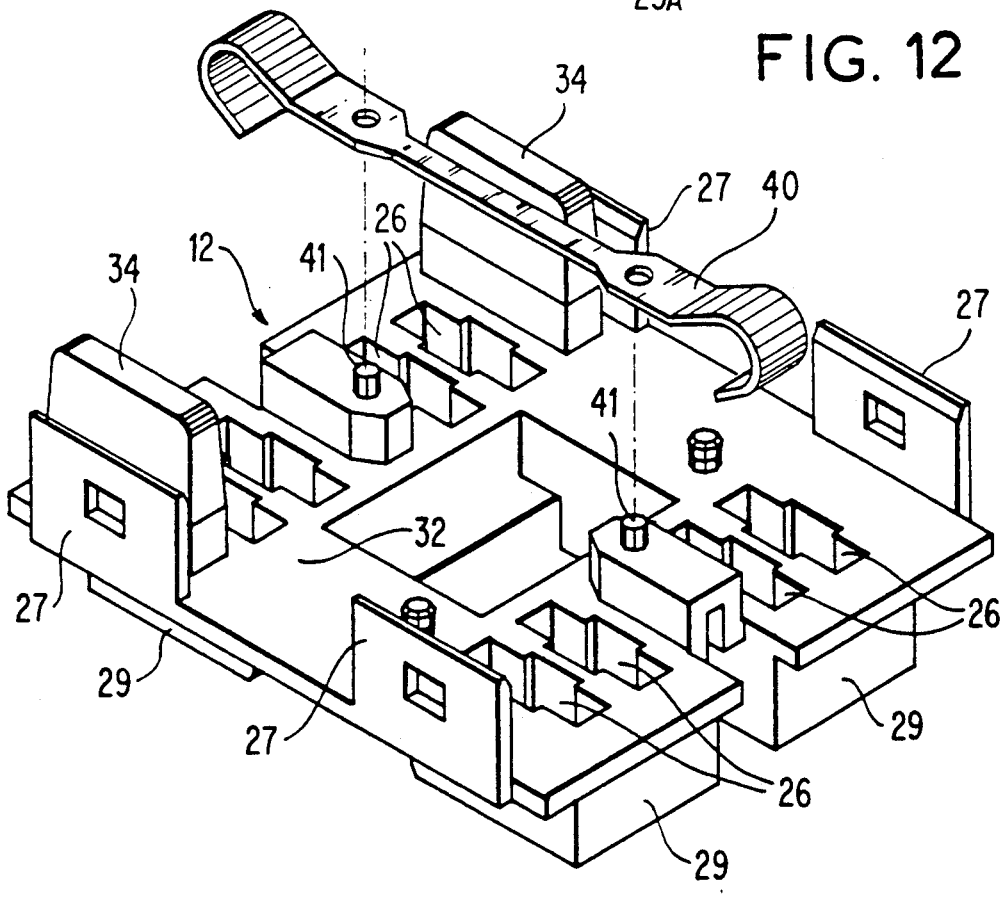
FIG. 12 shows the connection lid of the connector in perspective and seen from below, with the screening plate.

Slide 13, FIG. 13, comprises a carrier body 31 made from a moulded insulating material which is adapted to slide in a guide 32, of rectangular section, FIG. 12, formed in lid 12 above the cavities 21 when lid 12 is in position on the support block 5—FIGS. 5, 11, 13 and 14. The carrier body 31 comprises positioning slots 31A opening on to two opposite and faces and each intended to receive one of the knives 22 for cutting one of the wires 2A.

Knives 22 each comprises a positioning blade 22A, here bent at right angles, which penetrates laterally into one of the slots 31A for being immobilized there. Each positioning blade 22A is extended by a cutting blade 22B which projects under the carrier body 31 parallel to a cutting end 6C of a connection blade against which it rubs when the carrier body slides in its guide 32 in the direction of cavity 21, where it penetrates by one of its two extensions 31B each housing one of the positioning blades 22A into a positioning slot 22A. Each cutting blade 22B comprises a cutting edge 22C which is flush with a cutting end 6C and extends along the wall of cavity 21 which is situated perpendicularly under groove 20A in line with this cutting end when the connection piece which comprises this end 6C is in position. Each cutting blade 22B is extended laterally beyond its cutting edge 22C by a guide rib 22D whose end 22E is bent back rearwards so as to facilitate engagement of the cutting blade 22B against the cutting end 6C corresponding to the introduction of the extension which this blade carries into the cavity 21 which borders said cutting end.

Each extension 31B of the carrier body 31 has a guide wall which extends and is situated practically in the same plane as the face of the cutting blade 22B which cooperates with the corresponding cutting end 6C when connector 1 is assembled. On the other hand, the opposite comming face 31C of each extension 31B is oblique and overhanging so as to force the end of a wire 2A which has just been cut between the cutting blade 22B, which the extension 31B considered comprises, and the corresponding cutting end 6C and which is situated at the level of cavity 21 where the extension in question penetrates, to curve so as to enter into this cavity 21. Thus, there is no detachment of a wire section likely to move in the connector, if this latter is itself moved.

The inner and here outer form of each cavity 21 corresponds at least approximately to that of the corresponding extension 31B, a wire confinement space being formed between, on the one hand, wall 31C of an extension and the corresponding wall of cavity 21 where this extension penetrates, this wall here having the same slope and, on the other hand, between bottom 21A of the cavity and the end of the extension which is housed therein—FIG. 5.

Figure 15:
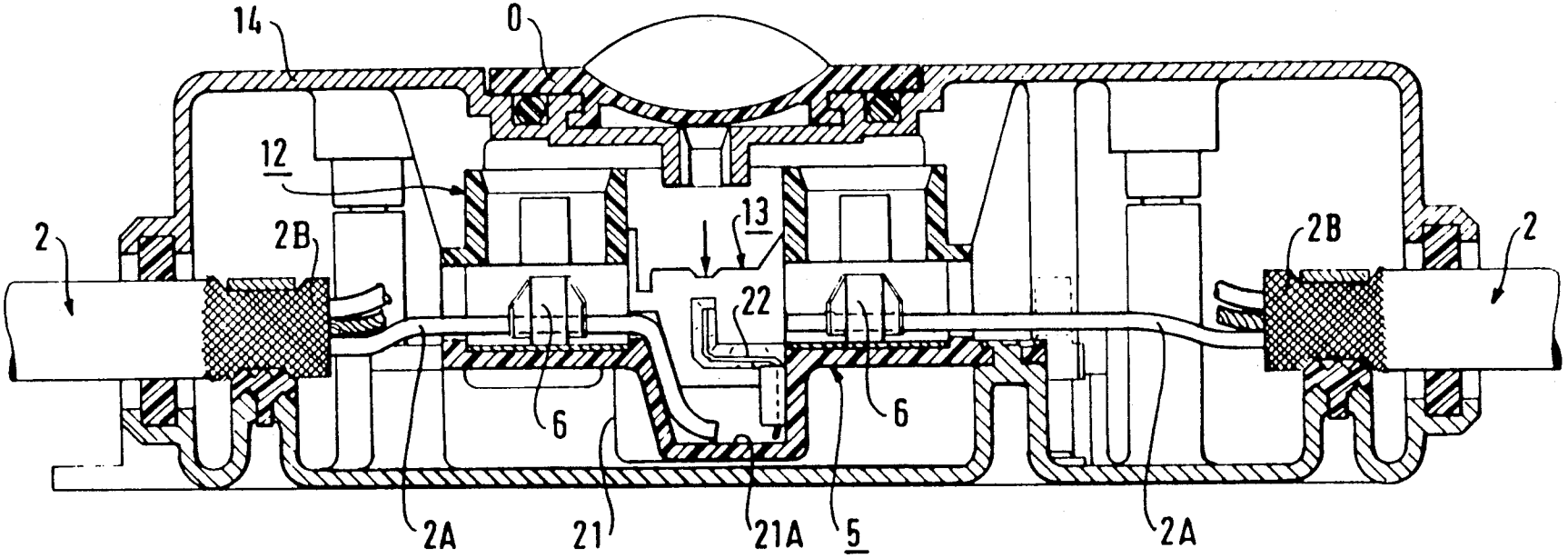
FIG. 15 is a longitudinal sectional view of the connector similar to that of FIG. 5 illustrating a slide thereof cutting a conductor extending through the connector.

The two knives 22 of the slide are disposed symmetrically with respect to a central axis parallel to the sliding direction, each on an opposite face of the slide for distributing the cutting forces in a balanced way which are applied simultaneously to the two wires 2A to be sectioned, when the extensions of slide 13 move down into cavities 21 as seen in FIG. 15.

Figure 14:
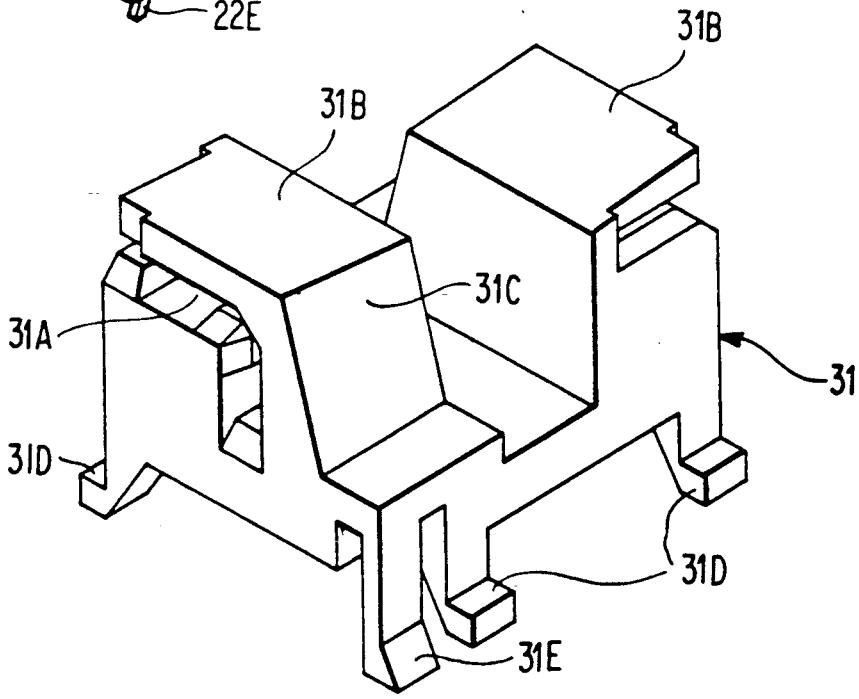
FIG. 14 shows the slide of the connector, without cutting blades, in perspective and in a bottom view.

This downward movement causes rigid holding lugs 31D, carried by the slide, to break at a given point so as to be held in a waiting position before connection with its extensions 31B out of the cavities 21—FIGS. 5, 13 and 14.

These holding lugs 31D bear by a projection on external flanges 33 of guide 32 opening on to the lid 12 outwardly of the assembly formed by the positioning of lid 12 on the support block 5. Penetration of slide 13 causes the holding lugs to break for example at their end bearing on one of the flanges 33.

Resilient holding lugs 31E are associated with holding lugs 31D. They are situated at the same level on slide 13 and are intended to be locked under the lid, after sliding in guide 32, when the extensions 31B of the slide enter the cavities 21 of the assembly formed by lid 12 and the support block 5 assembled together. Slide 13 is therefore held in position permanently after sectioning of the wires and at the end of fitting.

The cover 14 which closes the assembly formed by support block 5, lid 12 and slide 13 in the case which it forms with bottom 9, is also used for enabling slide 13 to fit into cavities 21 when case 9, 14 is closed. The support block 5 being fixed to bottom 9, in a given position and here on support elements such as 36—FIG. 5—of this bottom via conventional complementary devices 37—FIG. 10—and the cover being itself precisely fixed on the bottom as mentioned above, a tool insertion and positioning orifice 38 is provided, similar to orifice 26, on cover 14 in line with a tool bearing impression 31F formed in the middle of the top part 31G of the slide considered in position—FIGS. 3 and 5.

This makes it possible to fit the slide 13, FIG. 5, into cavities 21 by means of a connection tool blade used for connecting wires by driving the blade into case 9, 14, the tool being fixed to cover 14 by its fixing means mentioned above. Such an operation by which wires 2A are cut and connected in series does not then necessarily need to be carried out simultaneously with the connection of the wire to the conductor and may then be delayed without it being necessary to dismantle case 9, 14 for carrying it out.

An index 52, FIG. 13, formed by a rod with a coloured end, projects from the carrier body 31 in the vicinity of impression 31F, on the top part 31G of the slide; it is visible through a window situated beside orifice 38 on cover 14, when the slide does not penetrate into the cavities 21 and in particular before formation of the series connection which connector 1 is adapted to establish.

Driving of slide 13 into case 9, 14, which effects cutting the wires 2A of cable 2 which passes through connector 1, drives the latter to the visible end of index 52 and represents then visually, for an observer regarding the assembled case, this cut which is itself invisible when the case is closed.

The zone of cover 14, where orifice 38 opens, comprises a housing for a plug 0 which closes this orifice 38 when out of use; the zone of the cover situated on the other side of the wall with respect of this zone covered by plug 0 serves for immobilizing the slide 13 in position before penetration, while retaining the ends of lugs 31D, 32E between it and flanges 33.

In the embodiment proposed cover 14 is made from metal and forms a Faraday cage with bottom 9, both being preferably covered with an external insulating layer, not shown. This Faraday cage is connected electrically to the ground screening by collars 10 and screws 11 in so far as bottom 9 is connected and by a screening piece 40 which is here in the form of a metal blade curved in a C shape at both its ends so as to bear on the ground conductor 2C of the first cable 2—FIGS. 5, 10 and 11.

For this, the screening contact piece 40 is fixed on studs 41 carried by lid 12 on the same side as lugs 24 and studs 34, so as to be housed in groove 20C where the ground conductor 2C is positioned on which this ground piece bears by its curved ends. The latter are in addition subjected to the pressure exerted thereon by two extensions 50. FIG. 5, downwardly from the bottom of cover 14 for providing the electric continuity of this cover with ground wire 2C and consequently with the bottom 9 of the case and the screening sheaths 2B, 3B of the two cables 2 and 3 when connector 1 is mounted on these cables.

We claim:

1. Connector for wiring up a piece of equipment in series with a first cable (2) via a second cable (3), both for transmission of low electrical currents, said first cable comprising at least a pair of first, insulated conducting wires (2A) and a first electromagnetic screen metal sheath (2B) to which a ground wire (2C) is electrically connected, said second cable including second, insulated conducting wires (3A) and a second electromagnetic screen metal sheath (3B), wherein said connector comprises a support block having a plate, through grooves (20A, 20C) formed in said plate for individual passages of each of said first wires from one side of the support block to another side thereof, each of said through grooves being locally interrupted by a median cavity (21) and partly housing two connection pieces (6) each located on a different side of said median cavity, said connection pieces (6) each including cutting means (6C) at a cavity edge of a respective through groove to effect a transverse cut of a said first wire passing through a respective through groove, said plate further including blind end grooves (23A'), each said blind end groove opening on one side of the support block and being closed at one end thereof proximate to one of said through grooves, said one end partly housing one of said connection pieces, each connection pieces being further provided with baring and holding slots (6A) for interconnecting a second wire received in the closed groove end where said connection piece is partly housed, with the first wire situated in an adjacent through groove.

2. Connector according to claim 1, wherein the through grooves (20A) for the conducting wires (2A) of the first cable are situated parallel and on each respective sides of the through groove (20C) for the ground conductor (20C), the blind end grooves (23A, 23A') being laterally outside the through grooves and opening at the same end of the support block (5) in the vicinity of the opening of the through groove.

3. Connector according to claim 1, wherein a slide (13), is positioned on the other side of the cavities (21) of the support block (5) from said through grooves (2A) and being housed in a guide (32) within a lid (12) and fixed in a precise positioned above the grooves of the support block (5), slidable in the guide (32) and having two extensions (31B), penetrating into said cavities, each of said extensions having cutting means (22) complementary to said cutting edge at the edge of the cavity in each through groove (20A), for transversely cutting a wire (2A) passing longitudinally through a respective through groove.

4. Connector according to claim 3, wherein each extension (31B) comprises wire pushing means (31C) disposed opposite the cutting means (22) to push an overhung wire portion back into said cavity for causing said wire portions to remain fixed to the support block at the level of one of the connecting pieces (6).

5. Connector according to claim 1, wherein the cutting means at a through groove (20A) comprises an edge of a cutting end (6C) formed on each connection piece (56) and housed in said through groove at the edge of the cavity (21).

6. Connector according to claim 4, wherein the cutting means of the slide (13), are formed by a cutting blade (22) flush transversely with a cavity edge (21) extends there.

7. Connector according to claim 4, wherein the slide (13) comprises a cutting blade (22) at each extension (31B), each blade (22) being flush with the cutting end edge (6C) of a single one of the two connection pieces (6) housed in the through groove (20A at a cavity (21).

8. Connector according to claim 1, wherein a lid (12) is fixed in a precise position above the grooves of the support block (5) and comprises insection and positioning orifices (26) for receiving a connection tool with a sliding blade intended for pushing the various wires into the slots (6A) of the connection pieces (6) which were overhang.

9. Connector according to claim 3, wherein the support block (5) and the lid (12) are immoblized in a case (9, 14) having said first cable (2) passing therethough and said second cable (3) ending therein and extending at least substantially parallel to the first cable, and grouping together said second wires (3A, 3A'), said case being electrically conducting and connected to said metal sheaths (2B, 3B) of the cables by collars (10) fixing the cables on appropriate supports (8) of the case at positions where the metal sheaths are accessible and, through said ground conductor (2C) resting in a groove (20C) of the support block (5) by a ground piece situated between the support block and the lid (12) a bearing resiliently on the ground conductor where said ground conductor is situated on the support block and against conducting extensions (50) of the case.

10. Connector according to claim 8, wherein the support block (5) and the lid (12) are immobilized in the case (9, 14) having an insection and positioning orifice (38) for receiving a sliding blade connection tool for pushing different wires into slots (6A) of the connection pieces (6), said orifice extending vertically in line with a top part of the slide (13) and comprising an impression (31F) complementary to said sliding blade, to allow the slide to enter into the said cavities (21) for sectioning the conducting wires (2A) of the first cable (2) without opening the case.

11. Connector according to claim 5, wherein the slide (13) comprises visual signalling means (52), visible from outside the case (9, 14) of the connector (1), and indicating the state of penetration of the slide and sectioning of the conducting wires (2A) of the cable passing through said connector.

12. Connector according to claim 11, when the signalling means are formed by a rod (52) carried by the slide (13).

* * * * *